US005389008A

United States Patent [19]

Cheng et al.

[11] Patent Number: 5,389,008

[45] Date of Patent: Feb. 14, 1995

[54] LAMP SOCKET ASSEMBLY

[76] Inventors: You-Jen Cheng; Tzu-Ling Cheng, both of 2nd Fl., 18-9, Tienmu W. Road, Taipei City, Taiwan, Prov. of China

[21] Appl. No.: 176,465

[22] Filed: Jan. 3, 1994

[51] Int. Cl.[6] ..... H01R 4/24

[52] U.S. Cl. ..... 439/419; 439/414

[58] Field of Search ..... 439/659, 658, 419, 414, 439/404, 391

[56] References Cited

U.S. PATENT DOCUMENTS

| | | | |
|---|---|---|---|
| 864,427 | 8/1907 | Lawrence | 439/659 |
| 2,570,751 | 10/1951 | Benander | 439/419 |
| 2,636,069 | 4/1953 | Gilbert | 439/417 |
| 5,051,877 | 9/1991 | Liao | 439/419 |

FOREIGN PATENT DOCUMENTS

| | | | |
|---|---|---|---|
| 751055 | 1/1967 | Canada | 439/659 |

*Primary Examiner*—P. Austin Bradley
*Assistant Examiner*—James Miner
*Attorney, Agent, or Firm*—Ladas & Parry

[57] ABSTRACT

A lamp socket assembly comprises: (1) a socket shell with the top end being closed by a top wall with a central opening; (2) a socket cap fastened to the socket shell for holding down an electrical wire; (3) a first metal contact positioned between the socket cap and the top wall of the socket shell, the first metal contact for making electrical contact with the tip contact of a lamp bulb and with one conductor of the electrical wire; and (4) a second metal contact for making electrical contact with the ring contact of a lamp bulb and with at another conductor of the electrical wire. The first metal contact comprises an arched portion, which is received by and protrudes through the central opening in the top wall of the socket shell to make electrical contact with the tip contact of a lamp bulb. The first metal contact further comprises: (1) a triangular portion for piercing the insulator of the electrical wire to make electrical contact with one of the conductors of the electrical wire; and (2) a rectangular mounting portion, which is received by a cavity in the socket shell, thereby firmly retaining the first metal contact with respect to the socket shell. The first metal contact may be stamped from a sheet of metal.

6 Claims, 4 Drawing Sheets

LAMP SOCKET ASSEMBLY

BACKGROUND OF THE INVENTION

The present invention relates to a lamp socket assembly, and more particularly to the arrangement of the metal contact in a lamp socket assembly.

A prior art lamp socket assembly with which this invention concerned is shown in FIG. 6 and includes a socket shell 2; a socket cap 3 fastened to the socket shell for holding down an electrical wire; a first metal contact A making electrical contact with the tip contact of a lamp bulb 4 and with one conductor of the electrical wire; and a second metal contact 24 making electrical contact with the ring contact of the lamp bulb 4 and with the other conductor of the electrical wire. The first metal contact A has a vertical front end A1, which is inserted through a hole 26 in the top wall of the socket shell 2 and which pierces the insulating covering of the electrical wire to make electrical contact with one conductor of the electrical wire. The first metal contact A also has a horizontal rear end disposed inside the socket shell below an inside projecting portion 25 on the top wall of the socket shell 2. When the base of the lamp bulb 4 is threaded into the socket shell 2, the tip contact and the ring contact of the lamp bulb make electrical contact with, respectively, the first metal contact A and the second metal contact 24. Normally, the horizontal rear end of the first metal contact A is spaced from the projecting portion 25 on the top wall of the socket shell 2; and, therefore, it makes electrical contact with the tip contact of the lamp bulb 4 when the lamp bulb is threaded into the socket shell 2.

Still referring to FIG. 6, when the lamp bulb 4 is threaded into the socket shell 2, the tip contact of the lamp bulb is spaced from the projecting portion 25 on the top wall of the socket shell 2 at a distance longer than the thickness of the horizontal rear end of the first metal contact A. However, the first metal contact A tends to undergo elastic fatigue after long use. Therefore, a poor electrical contact or no electrical contact may occur when the horizontal rear end of the first metal contact A is disposed constantly in contact with the projecting portion 25 of the top wall of the socket shell 2.

SUMMARY OF THE INVENTION

The present invention is a lamp socket assembly with a first metal contact and a socket shell that work together to eliminate or reduce the problem described above. According to the preferred embodiment of the present invention, the first metal contact comprises an arched portion which projects into a central opening in the top wall of the socket shell to make electrical contact with the tip contact of the lamp bulb fastened to the socket shell. A triangular portion of the first metal contact pierces into the insulator on the electrical wire to make an electrical contact with the insulated conductor. A rectangular mounting portion of the first metal contact is firmly held in a cavity in the socket shell to stabilize the first metal contact.

DETAILED DESCRIPTION OF THE PREFERRED EMBODIMENT

Figure 1:
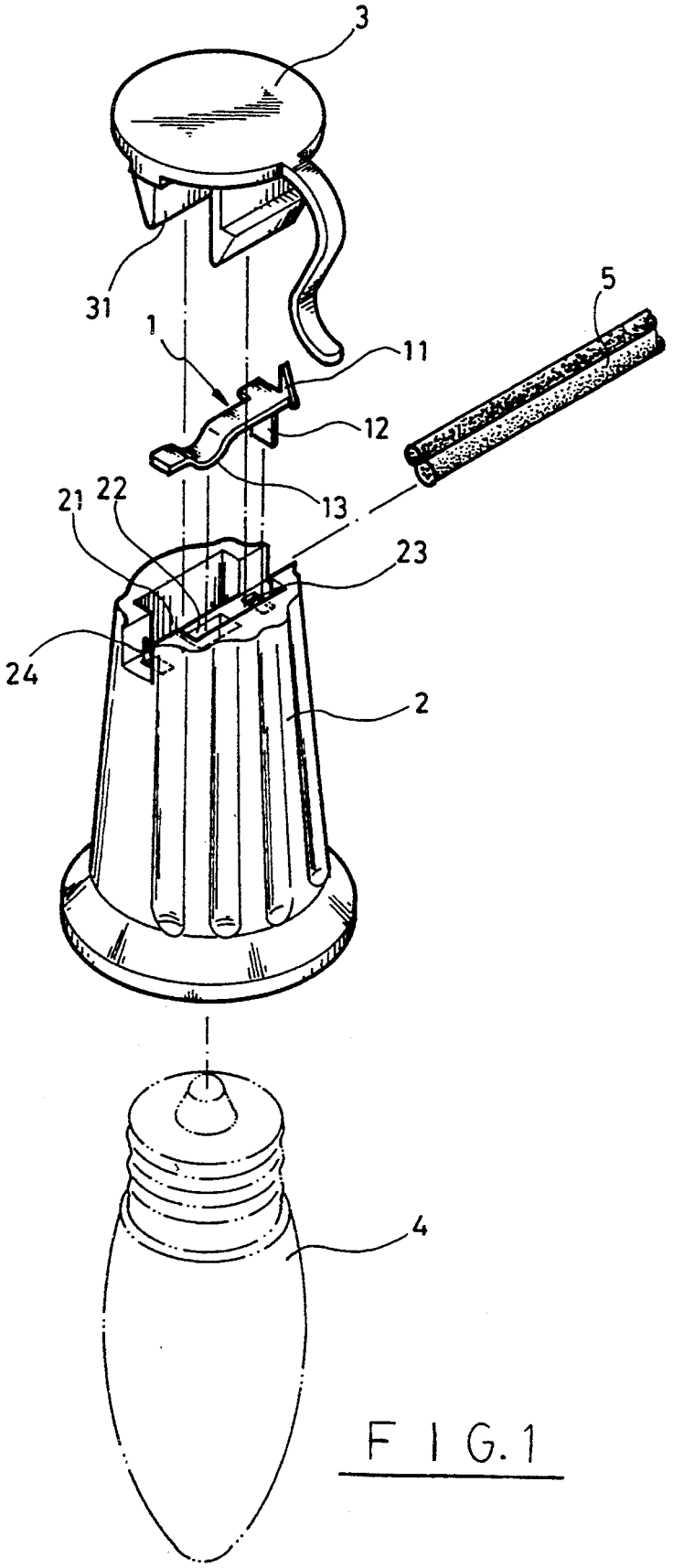
FIG. 1 is an exploded view of a lamp socket assembly according to the preferred embodiment of the present invention.
Figure 2:
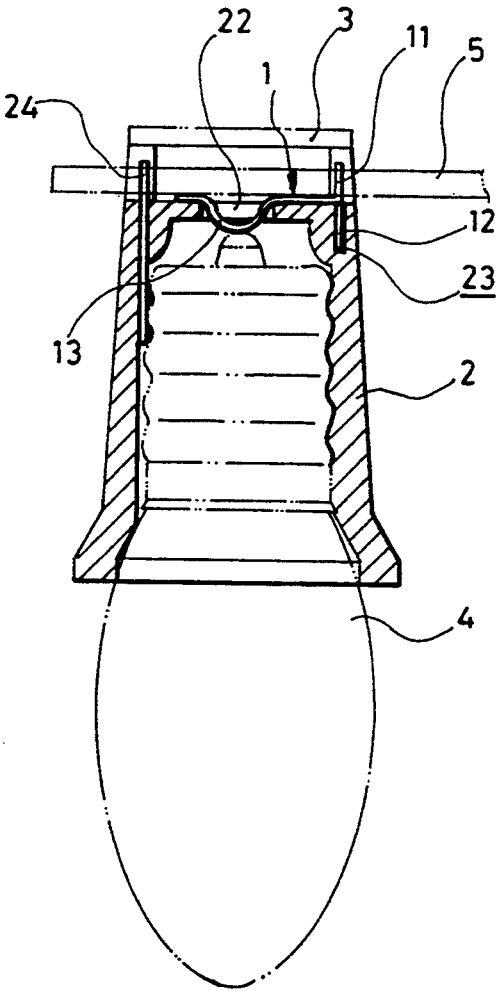
FIG. 2 is a longitudinal view in section of the lamp socket assembly shown in FIG. 1.

Referring to FIGS. 1 and 2, a lamp socket assembly in accordance with the preferred embodiment of the present invention is generally comprised of a socket shell 2 with a top end and a bottom end, the bottom end being open for receiving the base of a lamp bulb, the top end being closed by a top wall with a central opening 22; a socket cap 3 for holding down an electrical wire 5, the socket cap 3 being fastened to the socket shell 2 and covering the top end of the socket shell; a first metal contact 1 for making electrical contact with the tip contact of the lamp bulb and with one conductor of the electrical wire 5; and a second metal contact 24 for making electrical contact with the ring contact of the lamp bulb and with another conductor of the electrical wire 5. A lamp bulb 4 is inserted into the bottom end of the socket shell 2 and is screwed to the socket shell. The socket shell 2 has a transverse groove 21 through its top end for receiving the electrical wire 5. The socket cap 3 has two symmetrical hooks 31, which engage with respective retaining notches (not shown) in the transverse groove 21 of the socket shell 2 to hold the socket cap 3 in place and causing the first and second metal contacts 1, 24 to pierce the insulating covering on the electrical wire 5 and make respective contacts with the conductors in the electrical wire 5.

Figure 5:
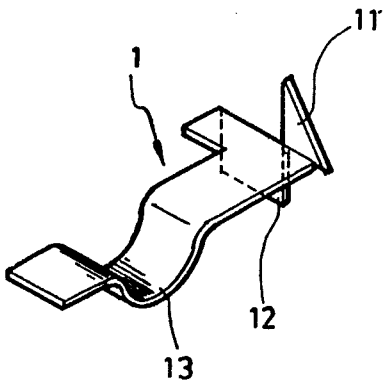
FIG. 5 is an elevational view of a first metal contact made from FIG. 4.
Figure 4:
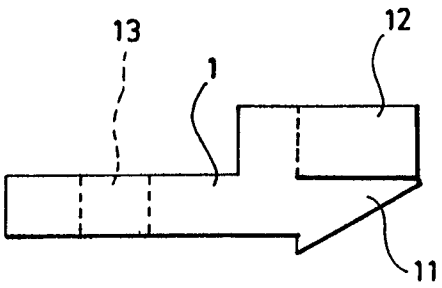
FIG. 4 is a plain view showing that the lined portion of FIG. 3 is removed.
Figure 3:
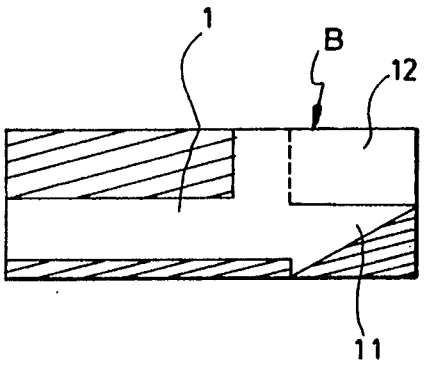
FIG. 3 shows a layout on a flat metal plate for making a first metal contact according to the present invention.
Figure 6:
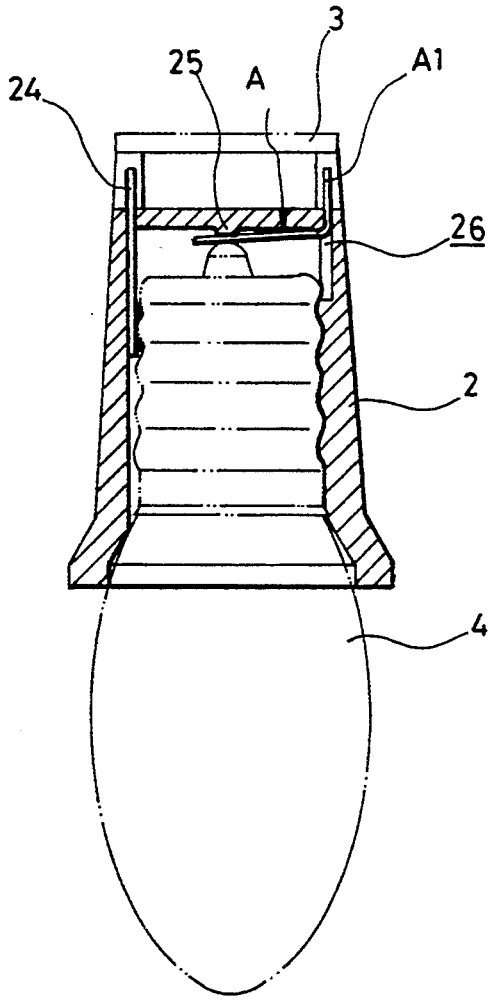
PRIOR ART FIG. 6
FIG. 6 is a longitudinal view in section of a lamp socket assembly according to the prior art.

Referring to FIGS. 3, 4, and 5, the first metal contact 1 is made from a flat metal plate B by stamping. As shown in FIG. 5, the first metal contact 1 comprises: (1) an arched portion 13 for protruding through the central opening 22 of the top wall of the socket shell 2 and for making electrical contact with the tip contact of a lamp bulb 4, as shown in FIGS. 1 and 2; (2) a triangular portion 11 for piercing the insulator of the electrical wire to make electrical contact with one of the conductors of the electrical wire; and (3) a rectangular mounting portion 12 which is received by cavity 23 in the socket shell 2, thereby firmly retaining the first metal contact 1 with respect to the socket shell 2, as shown in FIGS. 1 and 2. The triangular portion 11 is disposed in one direction and the arched portion 13 and the rectangular mounting portion 12 are disposed in the opposite direction.

Referring again to FIGS. 1 and 2, when the rectangular mounting portion 12 of the first metal contact 1 is inserted into cavity 23 in the socket shell 2, the arched portion 13 is received by and protrudes through the central opening 22 in the top wall of the socket shell 2. When the socket cap 3 is fastened to the socket shell 2, holding the electrical wire 5 in place, the triangular portion 11 of the first metal contact 1 pierces the insulating covering of the electrical wire 5 to make electrical contact with one conductor of the electrical wire 5; and the sharp tip of the second metal contact 24 pierces the insulating covering of the electrical wire 5 to make electrical contact with at another conductor of the electrical wire 5. When the lamp bulb 4 is fastened to the socket shell 2 by a screw joint, the tip contact of the lamp bulb 4 makes electrical contact with the arched portion 13 of the first metal contact 1; and the ring contact of the lamp bulb 4 makes electrical contact with the second metal contact 24.

What is claimed is:

1. A lamp socket assembly, comprising:

a socket shell with a bottom end and a top end, the bottom end being open for receiving the base of a lamp bulb, the top end being closed by a top wall with a central opening;

a socket cap for holding down an electrical wire, the socket cap being fastened to the socket shell and covering the top end of the socket shell;

a first metal contact positioned between the socket cap and the top wall of the socket shell, the first metal contact making electrical contact with a conductor of the electrical wire, the first metal contact having an arched portion which protrudes through the central opening of the top wall of the socket shell for making electrical contact with a tip contact of the lamp bulb; and a second metal contact for making electrical contact with another conductor of the electrical wire and with a ring contact of the lamp bulb.

2. The lamp socket assembly as claimed in claim 1, wherein the first metal contact has a triangular portion for piercing the insulator of the electrical wire to make electrical contact with a conductor of the electrical wire.

3. The lamp socket assembly as claimed in claim 1, wherein the first metal contact has a rectangular mounting portion, and wherein the socket shell has a cavity for receiving the rectangular mounting portion, thereby firmly retaining the first metal contact with respect to the socket shell.

4. The lamp socket assembly as claimed in claim 1, wherein:

the first metal contact further comprises a triangular portion for piercing the insulator of the electrical wire to make electrical contact with one of the conductors of the electrical wire, and a rectangular mounting portion; and the socket shell has a cavity for receiving the rectangular mounting portion and for firmly retaining the first metal contact with respect to the socket shell.

5. The lamp socket assembly as claimed in claim 4, wherein the first metal contact is stamped from a sheet of metal, so that the triangular portion is disposed in one direction and the arched portion and the rectangular mounting portion are disposed in the opposite direction.

6. The lamp socket assembly as claimed in claim 4, wherein the first metal contact is stamped from a sheet of metal, and wherein prior to stamping, that portion of the sheet of metal which subsequently forms the triangular portion of the first metal contact is then disposed adjacent that portion of the sheet of metal which subsequently forms the rectangular mounting portion of the first metal contact.

* * * * *